US005308470A

United States Patent [19]

Blackburn et al.

[11] Patent Number: 5,308,470

[45] Date of Patent: * May 3, 1994

[54] NON-CARCINOGENIC ASPHALTS AND ASPHALT BLENDING STOCKS

[75] Inventors: Gary R. Blackburn, Washington Crossing, Pa.; Carl R. Mackerer, Pennington; Timothy A. Roy, Hopewell, both of N.J.

[73] Assignee: Mobil Oil Corp., Fairfax, Va.

[ * ] Notice: The portion of the term of this patent subsequent to Jul. 23, 2008 has been disclaimed.

[21] Appl. No.: 996,293

[22] Filed: Dec. 23, 1992

Related U.S. Application Data

[60] Continuation-in-part of Ser. No. 708,532, Jul. 22, 1991, Pat. No. 5,178,747, which is a division of Ser. No. 329,735, Mar. 28, 1989, Pat. No. 5,034,119.

[51] Int. Cl.[5] ..... C10L 1/00

[52] U.S. Cl. ..... 208/14; 208/309; 208/177; 208/314; 208/347; 208/354; 208/86; 208/97; 208/88; 208/94; 208/96; 208/97; 208/DIG. 1; 435/29; 435/30; 435/34

[58] Field of Search ..... 208/14, 309, 177, 314, 208/347, 354, 86, 94, 96, 87, 88, 97, DIG. 1; 435/29, 30, 34

[56] References Cited

U.S. PATENT DOCUMENTS

| | | | |
|---|---|---|---|
| 2,713,023 | 7/1955 | Irvine | 202/40 |
| 3,886,062 | 5/1975 | Peiser et al. | 208/354 |
| 3,929,626 | 12/1975 | Button et al. | 208/309 |
| 3,989,612 | 11/1976 | Kragt et al. | 204/180 |
| 4,139,511 | 2/1979 | Hayashi et al. | 260/28.5 |
| 4,239,618 | 12/1980 | Peiser et al. | 208/355 |
| 4,261,814 | 4/1981 | Pfeifer | 208/356 |
| 4,321,094 | 3/1982 | Batt et al. | 106/285 |
| 4,499,187 | 2/1985 | Blackburn et al. | 435/34 |
| 4,869,809 | 9/1989 | Sarna | 208/DIG. 1 |
| 5,034,119 | 7/1991 | Blackburn et al. | 208/177 |
| 5,178,747 | 1/1993 | Blackburn et al. | 208/14 |

*Primary Examiner*—R. Bruce Breneman
*Assistant Examiner*—Patricia L. Hailey
*Attorney, Agent, or Firm*—Alexander J. McKillop; George W. Hager; Michael J. Mlotkowski

[57] ABSTRACT

Non-carcinogenic asphalts and asphalt blending stocks are produced from reduced hydrocarbon feedstocks. Such non-carcinogenic products are produced by establishing a functional relationship between mutagenicity index and a physical property correlative of hydrocarbon type for the asphalt or asphalt blending stock and determining a critical physical property level which, when achieved, results in a product having a mutagenicity index of less than about 1.0. Process conditions are established so that a product stream achieving the desired physical property level can be produced. Non-carcinogenic asphalts and asphalt blending stocks are then processed utilizing the conditions so established.

16 Claims, 4 Drawing Sheets

NON-CARCINOGENIC ASPHALTS AND ASPHALT BLENDING STOCKS

RELATED APPLICATIONS

This application is a continuation-in-part of copending application Ser. No. 07/708,532, filed on May 31, 1991, now U.S. Pat. No. 5,178,747 the contents of which are hereby incorporated in their entirety, which is a division of copending application Ser. No. 07/329,735, filed on Mar. 28, 1989, now U.S. Pat. No. 5,034,119.

FIELD OF THE INVENTION

The present invention relates to useful asphalt blending stocks and asphalt-based materials and to a process for their preparation. More particularly, this invention is directed to non-carcinogenic asphalt blending stocks and asphalt-based compositions, and to an improved combination of process steps for their production.

BACKGROUND OF THE INVENTION

In the production of asphalt, the primary asphalt stock or starting material for producing the finished asphalt is usually derived primarily from vacuum tower bottoms. Although crudes may be selected to produce asphalts of a desired quality, petroleum asphalt is primarily a product of integrated refineries. As such, crudes are generally selected on the basis of the requirements of other products and the asphalt produced therefrom may vary somewhat in characteristics from one crude system to another. To achieve required properties, deasphalting unit tars and solvent extraction unit extracts are often used together with vacuum tower bottoms and other refinery streams, as blending stocks to make finished asphalts.

When asphalts are produced as a byproduct of a lubricant refinery, asphalt blending stocks may be produced at any of several of the various process units employed to remove unwanted components from the feedstock. Such process units include atmospheric and vacuum distillation towers, deasphalting units, solvent extraction units, dewaxing units, etc. As is well known to those skilled in the art, lube refineries do not manufacture a single base stock but rather process several distillate fractions and a vacuum residuum fraction. For example, the vacuum residuum fraction, after deasphalting, solvent extraction and dewaxing, is commonly referred to as "bright stock." Each generally subtractive step of the lube base stock refining process produces a byproduct which may be used as an asphalt blending stock, depending upon its characteristics, processed further or sold to an industry which has developed a use for the byproduct.

The conventional processing of crude oil to recover fractions suitable for upgrading operations employs multi-stage distillation. Crude oil is first distilled in a atmospheric distillation tower with residual material from the bottom of the distillation tower being further separated in a vacuum distillation tower. In this combination operation, gas and gasoline generally are recovered as overhead products of the atmospheric distillation tower, heavy naphtha, kerosene and gas oils are taken off as distillate side streams and the residual material is recovered from the bottom of the tower a reduced crude. The residual bottoms fraction or reduced crude is usually charged to a vacuum distillation tower. The vacuum distillation step in lube refining provides one or more raw stocks within the boiling range of about 550° F. to 1050° F., as well as the vacuum residuum byproduct In lube refining, excess liquid runback, known as overflash material, may be combined with the vacuum residuum and either withdrawn from the tower or charged to a deasphalting unit for further processing or dealt with in other conventional ways known to those skilled in the art. The overflash material may alternatively be withdrawn, recovered and charged directly to a solvent extraction unit. The presence of metallic impurities, asphaltenes and the like may render this material unsuitable for this step or likewise, for a catalytic processing step. Typical vacuum distillation systems are disclosed in U.S. Pat. Nos. 2,713,023, 3,886,062, 4,239,618 and 4,261,814, incorporated herein by reference in their entirety. Vacuum tower designs particularly germane to the present invention are disclosed in U.S. Pat. Nos. 3,929,626 and 3,989,616, which are hereby incorporated by reference in their entirety.

Following vacuum distillation, each raw stock is extracted with a solvent, e.g. furfural, phenol or chlorex, which is selective for aromatic hydrocarbons, removing these undesirable components. The vacuum residuum usually requires an additional step, typically propane deasphalting, to remove asphaltic material prior to solvent extraction. The products produced for further processing into base stocks are known as raffinates. The raffinate from solvent refining is thereafter dewaxed by admixing with a solvent such as a blend of methyl ethyl ketone and toluene, for example and then processed into finished base stocks.

The solvent extraction step separates hydrocarbon mixtures into two phases; the previously described raffinate phase which contains substances of relatively high hydrogen to carbon ratio, often called paraffinic type materials, and an extract phase which contains substances of relatively low hydrogen to carbon ratio often called aromatic type materials. Solvent extraction is possible because different liquid compounds have different solution affinities for each other and some combinations are completely miscible while other combinations are almost immiscible. The ability to distinguish between high carbon to hydrogen aromatic type and low carbon to hydrogen or paraffinic type materials is termed selectivity. The more finely this distinguishing can be done the higher the selectivity of the solvent.

Furfural is typical of a suitable solvent extraction agent. Its miscibility characteristics and physical properties permit use with both highly aromatic and highly paraffinic oils of wide boiling range. Diesel fuels and light and heavy lubricating stocks are refined with furfural. Furfural exhibits good selectivity at elevated temperatures (175°-250° F.). In a typical furfural solvent extraction unit for lubricating oils, the raw feed is introduced below or about at the center of the extraction tower. Furfural is fed into the top or upper portion of the tower. Recycled extract may be introduced into the lower section of the tower as reflux. Likewise, internal reflux is effected in the tower by the temperature gradient which is brought about by introducing the solvent at an elevated temperature and by intermediate cooling systems. Furfural solvent is recovered from the raffinate and extract phase streams or layers in suitable distillation and stripping equipment. The stripped and recovered solvent is then recycled.

While the furfural solvent extraction unit raffinate goes on to further processing, the extract from the operation often finds utility in a broad range of applications.

including use as an asphalt blending stock, as indicated above. Bright stock extracts (BSE's), obtained by solvent-refining deasphalted vacuum resids during the production of bright stocks, are also useful in rubber processing and find utility as ink oils as well.

In recent years, concerns have arisen regarding the potential hazards associated with the use of asphalts and various blending stocks employed in the formulation of asphalts. For example, U.S. Pat. No. 4,139,511 notes that a particular paving material used in the paving of roads and airfields which "contains a large amount of a carcinogenic substance benzo(a)pyrene". U.S. Pat. No. 4,139,511 has as an object thereof to provide a uniform and satisfactorily hard asphalt composition containing little or no carcinogenic substance".

Asphalt products have heretofore been designed on the basis of engineering criteria only, such criteria including viscosity, ductility, penetration, etc. Only recently, however, has attention been directed toward the potential toxicity of asphalt and asphalt-based products. The toxicity issue of recent concern relates to the potential carcinogenicity of fumes generated from asphalt during end-use applications such as during paving an roofing operations.

To determine the relative carcinogenic activity of a asphalt composition or an asphalt blending stock such as a vacuum tower residuum, a propane deasphalting unit tar or an aromatic extract, a reliable test method for assaying such activity in complex hydrocarbon mixtures is required. A highly reproducible method showing strong correlation with the carcinogenic activity index of hydrocarbon mixtures is disclosed in U.S. Pat. No. 4,499,187, which is incorporated by reference in its entirety. From the testing of hydrocarbon samples as disclosed in U.S. Pat. No. 4,499,187, a property of the sample, known as its Mutagenicity Index (MI) is determined. Hydrocarbon mixtures exhibiting MI's less than or equal to 1.0 are known to be non-carcinogenic, while samples exhibiting MI's equal to about 0.0 are known to be completely free of mutagenic activity. As can be readily appreciated, it would be desirable to produce blending stocks for asphalts which are non-carcinogenic such that contact with same will not cause the development of cancerous growths in living tissue. It would be still more desirable to produce such materials which are free of mutagenic activity; that is, that contact with such products would not induce mutations in DNA and in living cells.

Therefore, what is needed is a process for the production of non-carcinogenic asphalts and asphalt blending stocks for use in roofing, paving and all other applications for which asphalt and bitumen are used.

SUMMARY OF THE INVENTION

In accordance with the present invention, a process for the production of a substantially non-carcinogenic asphalt blending stock from a reduced hydrocarbon crude feedstock is provided. The process comprises the steps of establishing a functional relationship between mutagenicity index and an asphalt blending stock physical property correlative of hydrocarbon type for an asphalt blending stock process stream; determining from said relationship a critical physical property level which, when achieved, an asphalt blending stock having a mutagenicity index of less than about 1.0 results; setting process conditions to produce an asphalt blending stock achieving said critical physical property level; and producing an asphalt blending stock wherein said asphalt blending stock is substantially non-carcinogenic having a mutagenicity index of less than about 1.0.

Also provided is a method for producing a substantially non-carcinogenic asphalt composition, the composition produced by blending a plurality of substantially non-carcinogenic asphalt blending stocks. Each of the blending stocks to be employed is produced by a process comprising the steps of: establishing a functional relationship between mutagenicity index and an asphalt blending stock physical property correlative of hydrocarbon type for an asphalt blending stock process stream; determining from said relationship a critical physical property level which, when achieved, an asphalt blending stock having a mutagenicity index of less than about 1.0 results; setting process conditions to produce an asphalt blending stock achieving said critical physical property level; and producing an asphalt blending stock wherein said asphalt blending stock is substantially non-carcinogenic having a mutagenicity index of less than about 1.0.

The 5% distillation boiling point is believed to be a particularly preferred physical property of the asphalt blending stocks for correlation with MI.

It is to be understood that, for the purposes of this disclosure, the use of the term "substantially non-carcinogenic asphalt blending stock" refers to both the whole blending stock, itself, and any fumes generated therefrom during end-use applications. Such end-use applications include, but are not limited to, paving and roofing operations.

It is, therefore, an object of this invention to provide a substantially non-carcinogenic asphalt blending stock.

It is a further object of this invention to provide a process for making a substantially non-carcinogenic asphalt blending stock.

It is another object of this invention to provide a substantially non-carcinogenic asphalt composition.

It is a yet further object of this invention to provide a process for making a substantially non-carcinogenic asphalt composition.

Other objects and the several advantages of the present invention will become apparent to those skilled in the art upon a reading of the specification and the claims appended thereto.

BRIEF DESCRIPTION OF THE DRAWINGS

The present invention will be better understood by referring to the following drawings in which like numerals identify like elements and in which.

DETAILED DESCRIPTION OF THE INVENTION

Figure 1:
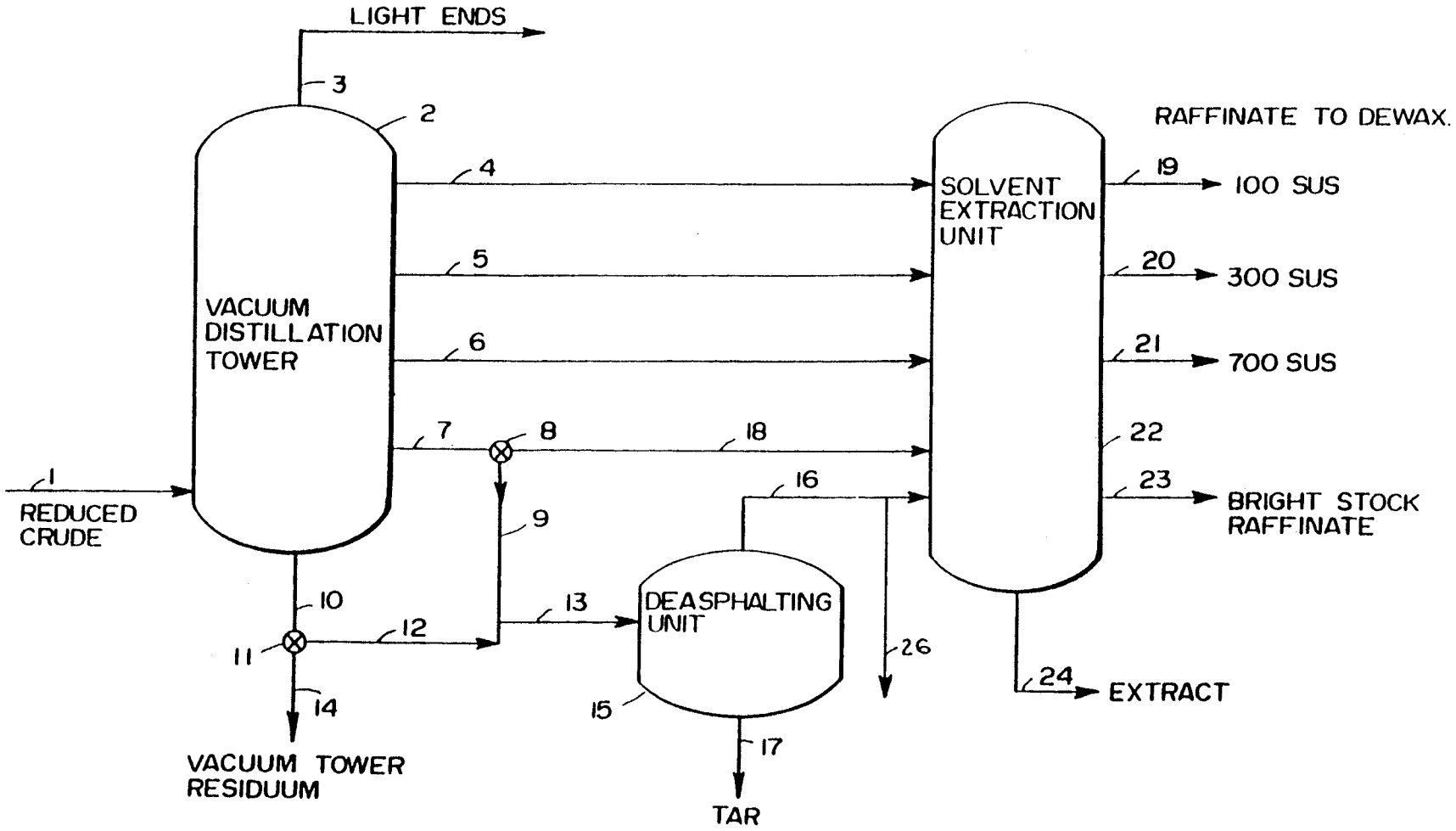
FIG. 1 is a partial lubricant refinery configuration which schematically represents the steps of vacuum distillation, deasphalting and solvent extraction, wherein a blended overflash and vacuum residuum feed to a deasphalting unit is utilized.

Any refinery capable of producing asphalt blending stocks is contemplated for use herein. The process of this invention will now be described with reference to FIG. 1, which schematically depicts a portion of a lubricant refinery. A suitable reduced crude prepared by atmospheric pressure distillation of a suitable base crude oil is passed via line 1 to crude unit vacuum distillation tower 2. Light ends are removed from the system via line 3. A light distillate fraction, which is a raw lubricant stock, known as light neutral oil, is passed from tower 2 via line 4 either to a storage tank, not shown, or to the solvent extraction unit 22 for further processing. Similarly, an intermediate neutral oil is passed via line 5, and a heavy neutral oil is passed via line 6, either to storage tanks (not shown) or to solvent extraction unit 22. An overflash boiling range material is withdrawn from conduit 7 located at a lower portion of the vacuum tower 2 above the reduced crude inlet conduit 1. Vacuum tower residuum is withdrawn from conduit 10. A portion of the vacuum tower residuum withdrawn from conduit 10 is withdrawn by conduit 12 and a portion of the overflash material withdrawn by conduit 7 is withdrawn by conduit 9. These portions are withdrawn and combined in conduit 13 and passed to deasphalting unit 15, where it is treated by any of a number of useful processes, such as propane deasphalting (PDA). The overflash material not withdrawn by conduit 9 for combining with the residuum is withdrawn by conduit 18 and may be stored in tankage, not shown, or solvent treated in extraction unit 22. The residuum not withdrawn by conduit 12 will pass through conduit 14 and may be stored in tankage (not shown) for subsequent use as a component for asphalt formulation or processed further as desired. Upon deasphalting, the deasphalted oil product, or raffinate, is withdrawn through conduit 16 and, either sent for further processing into bright stock or withdrawn and stored as DAO via conduit 26. The extract or tar from the deasphalting step is withdrawn through conduit 17 for subsequent use as a component for asphalt formulation. If bright stocks are to be produced, at a suitable point in time, the deasphalted oil raffinate is passed to a solvent extraction unit 22 through conduit 16 where it is treated with any one of a number of suitable solvents to remove undesirable constituents by preferential solution to produce a lubricant bright stock raffinate. The bright stock raffinate so produced is passed via conduit 23 and the extract removed via conduit 24. As mentioned, in the extraction unit 22, any suitable selective solvent may be used, such as furfural, phenol, chlorex, nitrobenzene, n-methylpyrrolodone, or others, with furfural being a particularly preferred solvent. At an appropriate point in time, the flow from conduit 16 is halted and flow from either conduit 4, 5 or 6 substituted therefor. The extraction unit will again remove the unwanted aromatic compounds and the light (100 SUS), intermediate (300 SUS) or heavy (700 SUS) neutral oil raffinate so produced, removed via conduit 19, 20 or 21, respectively and, once again, the extracts produced removed via conduit 24 for subsequent use as a component for asphalt formulation or other applications. The raffinates processed by the solvent extraction unit are dewaxed using any suitable process or stored in tankage (not shown) for later processing.

It will be recognized by those skilled in the art that the process stages described above are conventional. As may be appreciated, in some cases, unit 15 may provide a combined deasphalting and solvent extraction process. These and other variants are contemplated as within the scope of the present invention, the variations not being of material significance since they are not at the point of novelty of the present invention. It will be further recognized by those skilled in the art that the process being described is a blocked-out operation, but that variants thereof which would provide continuous flow are contemplated as within the scope of the present invention.

To produce non-carcinogenic asphalt blending stocks in accordance with the present invention, samples are withdrawn from either conduit 24 (for solvent extraction unit extract), conduit 26 (for deasphalted oil), conduit 17 (for deasphalting unit tar) and/or conduit 14 (for vacuum tower residuum) during preliminary runs, or from storage tanks (not shown) where previously collected samples reside. It can be beneficial to note the processing conditions responsible for producing a particular sample. Important parameters may include, but are not limited to: 1) percent of overflash material blended with crude unit vacuum tower residuum for charging the deasphalting unit; 2) the heavy-neutral distillate cut point; 3) other vacuum tower operating parameters such as steam inlet temperature, flashing zone absolute pressure and other internals; 4) deasphalting unit operating conditions, such as solvent treatment rate; 5) solvent extraction unit charge properties, such as whether blends of other streams are charged to the unit together with the deasphalted raffinate; and 6) solvent extraction unit operating conditions such as solvent treatment rate. Another variable worthy of note may be the crude or crude blend charged to the atmospheric distillation unit for producing the reduced crude charged to the crude unit vacuum distillation tower.

It has been discovered that polynuclear aromatic compounds (PNA) of 3 to 7 rings are responsible for the mutagenic/carcinogenic activity of asphalt blending stocks. These biologically active PNA are generally considered to fall in the boiling range of 640° to 1000° F. Additionally, it has been discovered that, as it relates to asphalts and asphalt blending stocks, when the amount of 3 to 7 ring PNA compounds exceeds a level of about 2% in such a material, that material will be found to exhibit mutagenic/carcinogenic activity. Therefore, when the term "substantial absence of a carcinogenic polynuclear aromatic compound of 3 to 7 rings in structure" is used herein, it is to be understood that the level of such compounds in that material is less than about 2%.

Unfortunately, suitable methods for reliably detecting these PNA's in the blend stocks used to produce asphalts do not exist. It has been found, however, that the distillation properties of a material, in particular, the 5% boiling point, can provide a process parameter indicative of the relative mutagenicity/carcinogenicity of a particular process stream. Also, the initial boiling point (IBP) of the stream has been found to provide another useful process parameter indicative of relative mutagenicity/carcinogenicity.

Figure 3:
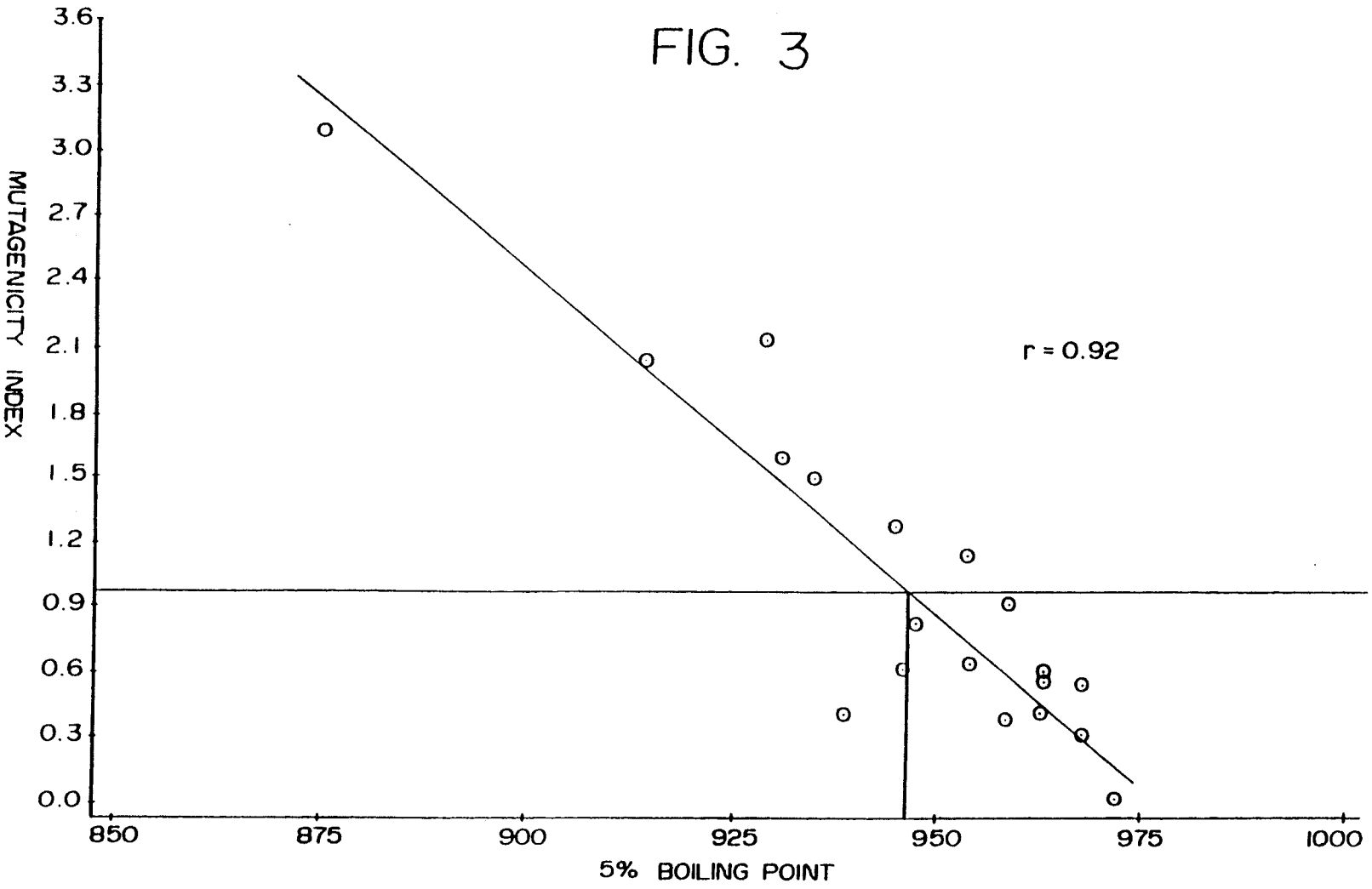
FIG. 3 presents a relationship between Mutagenicity Index, as determined by a Modified Ames Assay, and the 5% boiling point for 19 BSE's produced by Refinery A.

The samples collected are distilled using a standard method, such as ASTM D-1160, with preferably, at least the 5% boiling point (BP) recorded for each sample. Each sample is also tested to determine its relative mutagenicity. The Modified Ames Assay procedure disclosed in U.S. Pat. No. 4,499,187 is particularly preferred as it can rapidly and reliably determine the potential carcinogenic activity of hydrocarbon mixtures of petroleum origin. Mutagenicity index data obtained from the Modified Ames tests and 5% BP data obtained from distillation tests are regressed using well-known simple linear regression techniques to develop a linear relationship between these parameters characteristic of that refinery's basic operation. Mutagenicity index (MI), as disclosed in U.S. Pat. No. 4,499,187, is a ranking for relative mutagenic potency. MI is the slope of the dose response curve for mutagenesis. An example of such a regression line is shown in FIG. 3. Since non-carcinogenic oils are known to exhibit MI's of less than or equal to 1.0, the 5% BP which yields a value of MI=1.0 is determined from the regression relationship and selected as the "critical" 5% BP. Process conditions selected to produce a blend stock having a 5% BP at or above the critical 5% BP value will be non-carcinogenic. As may be seen from the regression relationship of FIG. 3, BSE's can also be produced having no mutagenic activity at all when they are produced to have a 5% BP at or above the point where MI=0. Likewise, other blending stocks free from mutagenic activity can also be produced in the same manner.

Reference is again made to FIG. 1. As mentioned, to achieve a material having a 5% BP at or above the critical value, processing alterations will likely be required. One alteration found to influence the distillation characteristics of a DAO or BSE having utility as an asphalt blending stock is the amount of overflash material blended with the vacuum residuum for charging the deasphalting unit 15. Should the lube refining process of FIG. 1 be present, the settings of valves 8 and/or 11, should they be present, could be varied to reduce the percentage of overflash material charged to the deasphalting unit. While the use of an overflash/residuum blend as a deasphalting unit charge is desirable from the standpoint that it increases the amount of bright stock produced while also producing bright stocks of somewhat lower viscosity, its use can now be optimized so that substantially non-carcinogenic asphalt blending stocks are also produced.

Figure 2:
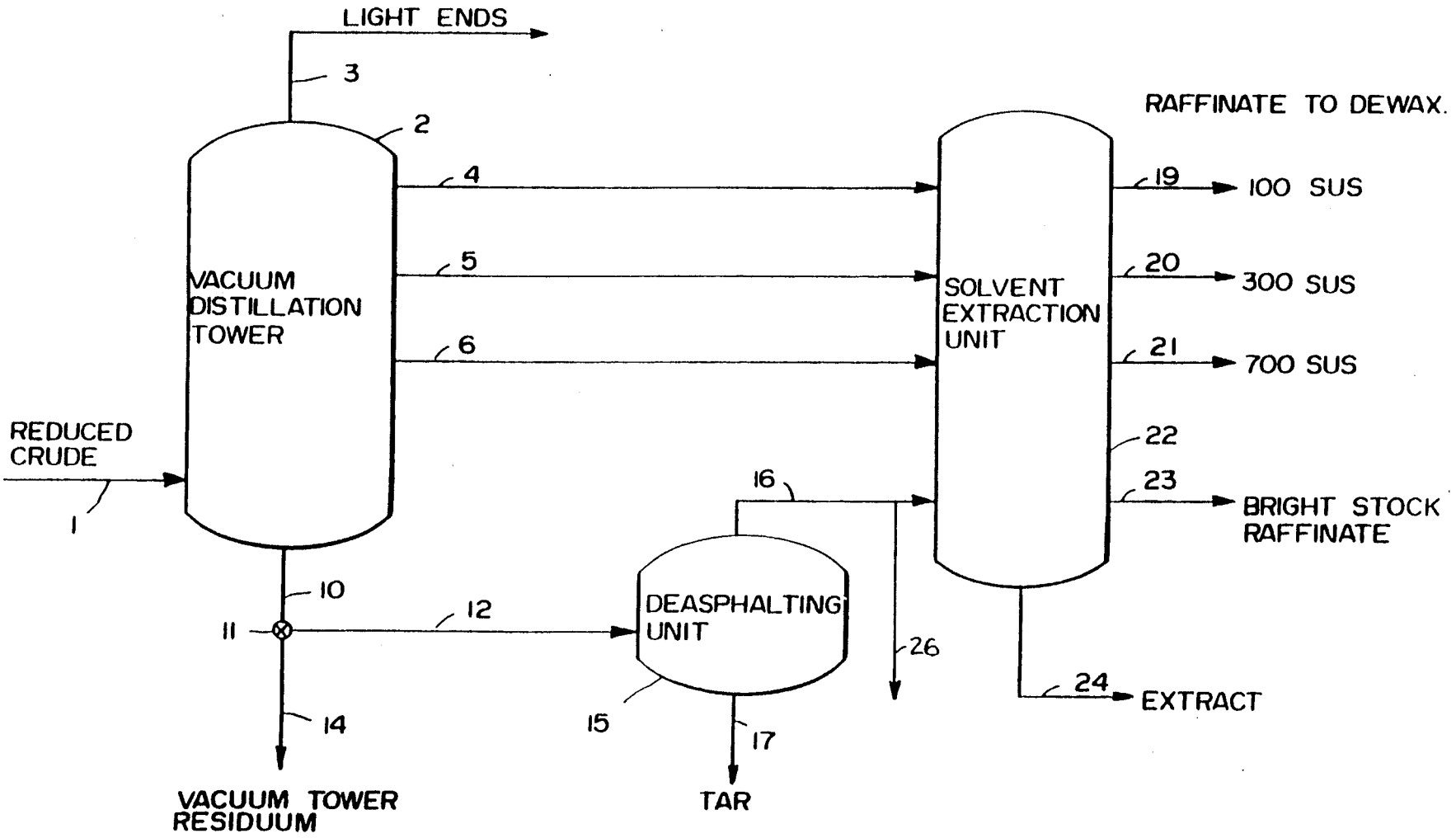
FIG. 2 is a partial lubricant refinery configuration which schematically represents the steps of vacuum distillation, deasphalting and solvent extraction wherein a straight vacuum residuum feed to a deasphalting unit is utilized.

It is important to recognize that the process of this invention is not limited to the refining processes depicted in FIG. 1 and explained above. Another example of partial lubricant refinery configuration useful in the practice of this invention is depicted in FIG. 2. The configuration shown in FIG. 2 is similar to that of FIG. 1, with the exception that no overflash side-draw is present for removal and blending with residuum for charging to the deasphalting unit 15. The process for producing a non-carcinogenic asphalts and asphalt blending stocks would be carried out as described above, with the exception that no ability to alter the 5% BP of the end-product by varying the percentage of overflash charged to the deasphalting u it would exist. Other process condition alterations, such as those described above or others known to those possessing ordinary skill in the art would be required and are envisioned as useful in the practice of this invention.

As indicated above, it is to be understood that the use of the term "substantially non-carcinogenic asphalt blending stock" refers to both the whole blending stock, itself, and any fumes generated during end-use applications, from an asphalt blending stock which has been produced in accordance with the present invention Such end-use applications include, but are not limited to, paving and roofing operations. In other words, the fumes generated from the blending stocks produced in accordance with the present invention are, themselves, substantially non-carcinogenic.

The invention is illustrated by the following examples.

EXAMPLE 1

In accordance with the process previously described, nineteen bright stock extracts were produced under varied process conditions at Refinery A, using various input crude blends, with representative samples of each taken. Mutagenicity tests were conducted using the Modified Ames Assay procedure previously referred to with two additional modifications. These were: a higher dose range (10–80 rather than the standard 5–50 1/plate) was employed, in keeping with the lower mutagenicity of these materials relative to that observed for typical vacuum distillates, the amount of sample extracted for testing was 2 grams rather than the 2 ml used for less viscous materials. Distillation profiles were obtained for each sample using ASTM D-1160. Data obtained are shown in Table 1 below.

TABLE 1

PROPERTIES OF BRIGHT STOCK EXTRACTS FROM REFINERY A

| Sample Number | Mutagenicity Index | 5% BP (°F.) | DESCRIPTION |
|---|---|---|---|
| 1 | 3.1 | 875 | Blended with heavy neutral extract; viscosity = 69.7 cSt |
| 2 | 2.0 | 915 | Furfural treat: 300%; PDA treat: 600% |
| 3 | 2.1 | 929 | Contains overflash; IBP = 718° F.; viscosity = 70.6 cSt |
| 4 | 1.6 | 931 | Furfural treat: 370%; PDA treat 600%; crude source: 13% Clyde, 11% Arab Light, 4% Beryl, 20% Statfjord, 52% Fulmar; IBP = 809° F.; viscosity = 61.3 cSt |
| 5 | 1.7 | 935 | 70% Statfjord, 30% Arab Light; viscosity = 50.3 |
| 6 | 1.3 | 945 | Furfural treat: 300%; PDA treat: 600%; crude source: 76% Statfjord, 17% Beryl, 7% Fulmar; viscosity = 65.7 cSt |
| 7 | 1.1 | 954 | Furfural treat 300%; PDA treat 600%; crude source 80–90% Fulmar, 10–20% Arab Light; viscosity 68.23 cSt |
| 8 | 0.9 | 957 | Furfural treat = 300%; PDA treat = 600%; crude source: 54% Fulmar, 30% Statfjord, 13% Clyde, 3% Arab Light |
| 9 | 0.8 | 947 | Furfural treat: 300%, PDA treat: 600% crude source: Statfjord/Fulmar; viscosity = 64.0 cSt |
| 10 | 0.6 | 945 | Furfural treat: 300%; PDA treat: 600%; crude source: Statfjord/Fulmar; viscosity = 65.4 cSt |
| 11 | 0.6 | 954 | Furfural treat: 300% PDA treat: 600%; crude source: Statfjord/Fulmar; viscosity = 66.0 cSt |
| 12 | 0.6 | 962 | Furfural treat: 300%; PDA treat: 600%; crude source: 85% Statfjord, 15% Fulmar; viscosity = 63.2 cSt |
| 13 | 0.5 | 962 | Furfural treat: 300%; PDA treat: 600%; crude source: 52% Statfjord, 33% Fulmar, 11% Clyde, 4% Arab Light |
| 14 | 0.0 | 968 | Furfural treat: 300%; PDA treat: 600%, crude source: 52% Statfjord, 33% Fulmar, 11% |

TABLE 1-continued

| PROPERTIES OF BRIGHT STOCK EXTRACTS FROM REFINERY A | | | |
|---|---|---|---|
| Sample Number | Mutagenicity Index | 5% BP (°F.) | DESCRIPTION |
| 15 | 0.4 | 939 | Clyde, 4% Arab Light From North Sea crude; viscosity = 68 cSt |
| 16 | 0.4 | 958 | Viscosity = 70.3 cSt |
| 17 | 0.4 | 962 | Furfural treat: 350%; PDA treat: 600%; crude source: 59% Statfjord, 18% Beryl, 15% Fulmar, 4% Clyde, 4% Arab Light |
| 18 | 0.3 | 968 | Furfural treat: 350%; PDA treat: 600%; crude source: 59% Statfjord, 18% Beryl, 15% Fulmar, 4% Clyde, 4% Arab Light |
| 19 | 0.0 | 973 | Furfural treat: 370%; PDA treat: 600%; crude source: 2% Clyde, 2% Arab Light, 13% Beryl, 79% Statfjord, 4% Fulmar; IBP = 873° F. |

The 5% BP and MI data were linearly regressed using well-known techniques to determine the relationship between those variables. The results of this regression are shown in FIG. 3. As shown in FIG. 3, excellent correlation was established, with a correlation coefficient, r, of 0.92 found. The critical 5% BP (MI=1) was found to be about 945° F. for Refinery A. Additionally, from this relationship, it can be seen that a BSE having substantially no mutagenic activity (MI=0) should be produced when the 5% BP exceeds about 978° F.

Knowing the critical 5% BP required to produce a substantially non-carcinogenic BSE, process conditions can be established, as one skilled in the art would recognize, to achieve BSE production consistently having a 5% BP at or above the critical value. Non-carcinogenic bright stock extract can then be produced using the processes previously described and the resultant material used as a blending stock to produce the non-carcinogenic asphalts of this invention.

EXAMPLE 2

At Refinery B, five bright stock extracts were produced under varied process conditions and sampled. As in Example 1, MI and 5% BP were determined for each sample. These data are shown below in Table 2.

TABLE 2

| PROPERTIES OF BRIGHT STOCK EXTRACTS FROM REFINERY B | | | |
|---|---|---|---|
| Sample Number | Mutagenicity Index | 5% (°F) | DESCRIPTION |
| 20 | 2.2 | 879 | BSE, viscosity = 70.3 cSt |
| 21 | 2.1 | 887 | BSE, viscosity = 70.3 cSt |
| 22 | 1.6 | 884 | BSE, viscosity = 70.3 cSt |
| 23 | 1.5 | 904 | BSE, viscosity = 70.3 cSt |
| 24 | 1.1 | 921 | BSE, viscosity = 70.3 cSt |

Figure 4:
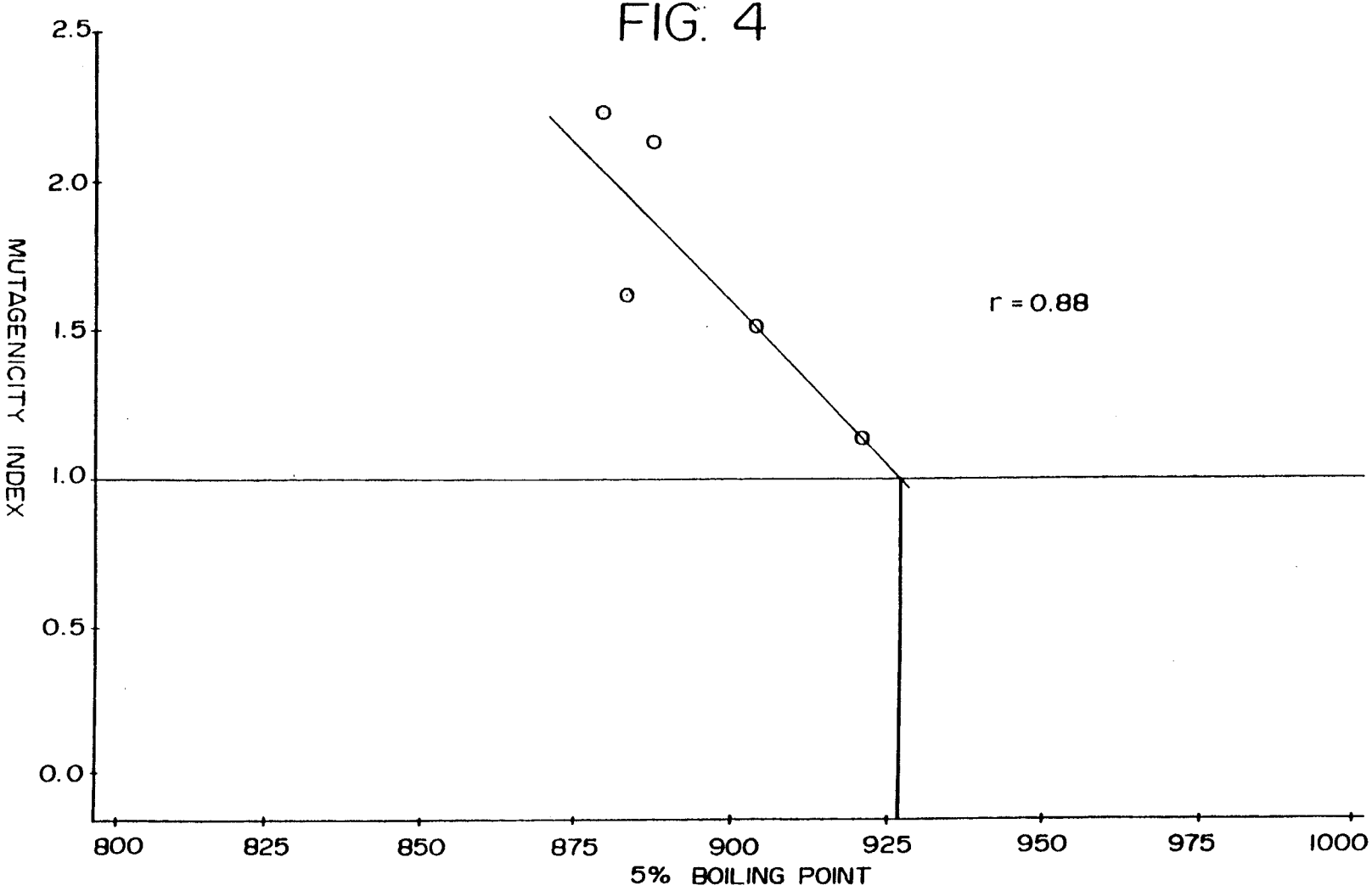
FIG. 4 presents a relationship between Mutagenicity Index, as determined by a Modified Ames Assay, and the 5% boiling point for 5 BSE's produced by Refinery B.

The 5% BP and MI data were linearly regressed to determine the relationship characteristic of Refinery B. The results of this regression are shown in FIG. 4. Again, excellent correlation is achieved, with an r value of 0.88 found. The critical 5% BP was found to be about 925° F. for Refinery B. Again, as at Refinery A, a BSE substantially free from mutagenic activity should be produced when the 5% BP exceeds about 978° F.

Using the knowledge of one skilled in the art, Refinery B's process conditions can be adjusted to achieve BSE production consistently having 5% BP's at or above the critical value of 925° F. The bright stock extract can then be produced in the manner previously described. By following these process steps non-carcinogenic BSE can be produced for use as an asphalt blending component.

EXAMPLE 3

At a lubricant refinery configured substantially as depicted in FIG. 1, ten deasphalting unit tars are produced under varied process conditions during trial runs and sampled. As in Examples 1 and 2, MI and 5% BP are determined for each sample and linearly regressed. The critical 5% BP is determined from the regression relationship so obtained.

Using the knowledge of one skilled in the art, refinery process conditions are adjusted to achieve deasphalting unit tar production consistently having 5% BP's at or above the critical value. The non-carcinogenic deasphalting unit tar can then be produced in the manner previously described. By following these process steps non-carcinogenic asphalts can be produced by blending the non-carcinogenic blending stocks of Examples 1 and/or 2 with the deasphalting unit tar produced in prophetic Example 3.

EXAMPLE 4

Again, at a lubricant refinery configured substantially as depicted in FIG. 1, ten vacuum tower resids are produced under varied process conditions during trial runs and sampled. As in Examples 1 and 2, MI and 5% BP are determined for each sample and linearly regressed. The critical 5% BP is determined from the regression relationship so obtained.

Refinery process conditions are adjusted, using the knowledge of one skilled in the art, to achieve vacuum tower residuum production consistently having 5% BP's at or above the critical value. The non-carcinogenic vacuum tower residuum can then be produced in the manner previously described. By following these process steps non-carcinogenic asphalts can be produced by blending the non-carcinogenic blending stocks of Examples 1 and/or 2 with the deasphalting unit tar produced in prophetic Example 3 and the vacuum tower residuum produced in prophetic Example 4. The asphalt composition can be blended to meet the American Society for Testing and Materials (ASTM) specifications for a medium-curing paving asphalt (ASTM D 2027).

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A process for the production of a substantially non-carcinogenic asphalt blending stock from a reduced hydrocarbon crude feedstock, comprising the steps of:

(a) establishing a functional relationship by regression between mutagenicity index and an asphalt blending stock physical property indicative of mutagenicity for an asphalt blending stock process stream;

(b) determining from said relationship a critical physical property level which, when achieved, an asphalt blending stock having a mutagenicity index of less than about 1.0 results, said critical property being the physical property which yields a value of mutagenicity index equal to 1.0;

(c) setting process conditions to produce an asphalt blending stock achieving said critical physical property level; and (d) producing an asphalt blending stock, said deasphalted oil producing step comprising:

(i) passing the reduced feedstock into a vacuum distillation column wherein the feedstock is separated into at least one product of distillation and a vacuum residuum byproduct; and (ii) passing at least a fraction of said residuum byproduct through a selective solvent deasphalting unit to produce a deasphalted raffinate and an asphaltenic extract, wherein said asphalt blending stock is substantially non-carcinogenic having a mutagenicity index of less than about 1.0.

2. The process of claim 1, wherein said step of producing an asphalt blending stock further comprises the step of:

(g) passing at least a fraction of said deasphalted raffinate through at least one selective solvent extraction unit to reduce said deasphalted raffinate's aromatic content and to produce a bright stock and the bright stock extract.

3. The process of claim 1, wherein said physical property is a distillation property.

4. The process of claim 3, wherein said distillation property is a distillation boiling point value.

5. The process of claim 4, wherein said distillation boiling point value is selected from the group consisting of initial boiling point and 5% boiling point.

6. The process of claim 1, wherein the selective solvent of said selective solvent deasphalting unit is propane.

7. The process of claim 6, wherein the overflash material is produced by step (d)(i) and at least a portion of this material is combined with said vacuum residuum and processed according to step (d)(ii).

8. The process of claim 7, wherein step (c) includes setting an amount of overflash material for combining with said vacuum residuum prior to selective solvent deasphalting.

9. The process of claim 8, wherein said amount of overflash material is selected to provide a maximum asphalt blending stock yield.

10. The process of claim 8, wherein said amount of overflash material does not exceed about 10 volume percent of selective solvent deasphalting unit feedstock.

11. A non-carcinogenic asphalt blending stock produced from a vacuum residuum said asphalt blending stock characterized by a substantial absence of carcinogenic polynuclear aromatic compounds of 3 to 7 rings in structure, said asphalt blending stock having a mutagenicity index of less than about 1.0.

12. A method for producing a substantially non-carcinogenic asphalt composition, the composition produced by blending a plurality of substantially non-carcinogenic asphalt blending stocks, each of the blending stocks produced by a process comprising the steps of:

(a) establishing a functional relationship by regression between mutagenicity index and an asphalt blending stock physical property indicative of mutagenicity for an asphalt blending stock process stream;

(b) determining from said relationship a critical physical property level which, when achieved, an asphalt blending stock having a mutagenicity index of less than about 1.0 results, said critical property being the physical property which yields a value of mutagenicity index equal to 1.0;

(c) setting process conditions to produce an asphalt blending stock achieving said critical physical property level; and (d) producing an asphalt blending stock, said deasphalted oil producing step comprising:

(i) passing the reduced feedstock into a vacuum distillation column wherein the feedstock is separated into at least one product of distillation and a vacuum residuum byproduct; and (ii) passing at least a fraction of said residuum byproduct through a selective solvent deasphalting unit to produce a deasphalted raffinate and an asphaltenic extract, wherein said asphalt blending stock is substantially non-carcinogenic having a mutagenicity index of less than about 1.0.

13. The process of claim 12, wherein said step of producing an asphalt blending stock further comprises the step of:

(g) passing at least a fraction of said deasphalted raffinate through at least one selective solvent extraction unit to reduce said deasphalted raffinate's aromatic content and to produce a bright stock and the bright stock extract.

14. The process of claim 12, wherein said physical property is a distillation property.

15. The process of claim 14, wherein said distillation property is a distillation boiling point value.

16. The process of claim 15, wherein said distillation boiling point value is selected from the group consisting of initial boiling point and 5% boiling point.

* * * * *